US011488546B2

(12) United States Patent
Lee

(10) Patent No.: US 11,488,546 B2
(45) Date of Patent: Nov. 1, 2022

(54) DISPLAY DEVICE AND OPERATING METHOD THEREOF

(71) Applicant: Samsung Display Co., Ltd., Yongin-Si (KR)

(72) Inventor: Kyung-Hun Lee, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/110,656

(22) Filed: Dec. 3, 2020

(65) Prior Publication Data

US 2021/0183324 A1 Jun. 17, 2021

(30) Foreign Application Priority Data

Dec. 12, 2019 (KR) ..... 10-2019-0165959

(51) Int. Cl.
*G09G 3/34* (2006.01)
*G09G 3/36* (2006.01)
*G09G 3/3225* (2016.01)

(52) U.S. Cl.
CPC ..... *G09G 3/3426* (2013.01); *G09G 3/3225* (2013.01); *G09G 3/3696* (2013.01); *G09G 2320/0233* (2013.01); *G09G 2320/0285* (2013.01); *G09G 2320/043* (2013.01); *G09G 2320/048* (2013.01)

(58) Field of Classification Search
CPC .. G09G 3/006; G09G 3/36; G09G 2300/0833; G09G 2310/0243; G09G 2310/0272; G09G 2310/0291; G09G 2320/0276; G09G 2290/00; G09G 3/2092; G09G 3/3696; G09G 2300/043; G09G 3/20
See application file for complete search history.

(56) References Cited

U.S. PATENT DOCUMENTS 8,305,319 B2 * 11/2012 Chang ..... G09G 3/3655 345/94
8,411,008 B2 * 4/2013 Song ..... G09G 3/3655 345/95
8,643,588 B2 * 2/2014 Chan ..... G09G 3/3406 345/102
8,922,595 B2 * 12/2014 Ahn ..... G09G 3/3233 345/690

(Continued)

FOREIGN PATENT DOCUMENTS

KR 1020170026974 A 3/2017

*Primary Examiner* — Michael J Jansen, II
(74) *Attorney, Agent, or Firm* — Cantor Colburn LLP

(57) ABSTRACT

A driving controller of a display device includes a timer which counts an operation time and outputs a count signal, a memory which stores compensation data, a control signal generation part which receives the compensation data from the memory in response to the count signal and outputs a compensation data signal corresponding to the compensation data, and an image processor which converts an image signal into a data signal and outputs the data signal, where the data signal is obtained by combining the image signal and the compensation data signal. The compensation data includes first compensation data corresponding to a first operation time and second compensation data corresponding to a second operation time which is different from the first operation time.

18 Claims, 16 Drawing Sheets

(56) References Cited

U.S. PATENT DOCUMENTS

| | | | | |
|---|---|---|---|---|
| 10,665,198 | B2 * | 5/2020 | Lee | G09G 3/3406 |
| 11,132,949 | B2 * | 9/2021 | Kim | G09G 3/3258 |
| 11,257,450 | B2 * | 2/2022 | Koo | G09G 3/3607 |
| 2008/0122832 | A1 * | 5/2008 | Chen | G09G 3/32 345/214 |
| 2009/0160839 | A1 * | 6/2009 | Song | G09G 3/3655 345/211 |
| 2009/0243987 | A1 * | 10/2009 | Chang | G09G 3/3655 345/94 |
| 2010/0164999 | A1 * | 7/2010 | Chan | G09G 3/3406 345/690 |
| 2012/0212516 | A1 * | 8/2012 | Ahn | G09G 3/3233 345/690 |
| 2019/0005907 | A1 | 1/2019 | Koo et al. | |
| 2019/0088228 | A1 | 3/2019 | Lee | |
| 2021/0201779 | A1 * | 7/2021 | Kim | G09G 5/06 |

* cited by examiner

DISPLAY DEVICE AND OPERATING METHOD THEREOF

This application claims priority to Korean Patent Application No. 10-2019-0165959, filed on Dec. 12, 2019, and all the benefits accruing therefrom under 35 U.S.C. § 119, the content of which in its entirety is herein incorporated by reference.

BACKGROUND

1. Field

Embodiments of the invention herein relate to a display device, and more particularly, to a display device including a driving circuit.

2. Description of Related Art

In general, a display device includes a display panel for displaying an image and a driving circuit for driving the display panel. The display panel typically includes a plurality of scan lines, a plurality of data lines, and a plurality of pixels.

The driving circuit typically includes a data driving circuit for outputting a data driving signal to the data lines, a scan driving circuit for outputting a scan signal for to the scan lines, and a driving controller for controlling the data driving circuit and the scan driving circuit.

Such a display device may display an image by outputting a scan signal to a scan line connected to a pixel to be displayed and providing a data voltage corresponding to a display image to a data line connected to the pixel. The driving controller controls the scan driving circuit and the data driving circuit.

SUMMARY

In a display device, characteristics of the pixel and/or the driving circuit may vary according to an operation environment (e.g., an ambient temperature, an operation time, etc.) of the display panel. Such variations may degrade uniformity of display quality.

Embodiments of the invention provide a display device in which display quality deterioration is prevented and an operation method thereof.

An embodiment of the invention provides a driving controller including: a timer which counts an operation time and output a count signal; a memory which stores first compensation data corresponding to a first operation time and second compensation data corresponding to a second operation time which is different from the first operation time; a control signal generation part which receives one of the first compensation data and the second compensation data as compensation data from the memory in response to the count signal and outputs a compensation data signal corresponding to the compensation data; and an image processor which converts an image signal into a data signal, and output the data signal, where the data signal is obtained by combining the image signal and the compensation data signal.

In an embodiment, the second operation time may have a value greater than a value of the first operation time, the control signal generation part may receive the first compensation data from the memory as the compensation data when the count signal is greater than the value of the first operation time and less than the value of the second operation time, and the control signal generation part may receive the second compensation data from the memory as the compensation data when the count signal is greater than the value of the second operation time.

In an embodiment, the control signal generation part may output the compensation data signal corresponding to 0 when the count signal is less than the value of the first operation time and the value of the second operation time.

In an embodiment, the image signal may correspond to each of a plurality of display blocks, and each of the first compensation data and the second compensation data may be individually set for each of the plurality of display blocks.

In an embodiment of the invention, a display device includes: a display panel including a plurality of pixels connected to a plurality of data lines and a plurality of scan lines, respectively; a data driving circuit which drives the plurality of data lines; a scan driving circuit which drives the plurality of scan lines; and a driving controller which receives a control signal and an image signal and control the data driving circuit and the scan driving circuit to display an image on the display panel. In such an embodiment, the driving controller includes: a timer which counts an operation time and output a count signal; a memory which stores first compensation data corresponding to a first operation time and second compensation data corresponding to a second operation time which is different from the first operation time; a control signal generation part which receives one of the first compensation data and the second compensation data as compensation data from the memory in response to the count signal and outputs a compensation data signal corresponding to the compensation data; and an image processor which converts an image signal into a data signal and outputs the data signal to the data driving circuit, where the data signal is obtained by combining the image signal and the compensation data signal.

In an embodiment, the second operation time may have a value greater than a value of the first operation time, the control signal generation part may receive the first compensation data from the memory as the compensation data when the count signal is greater than the value of the first operation time and less than the value of the second operation time, and the control signal generation part may receive the second compensation data from the memory as the compensation data when the count signal is greater than the value of the second operation time.

In an embodiment, the control signal generation part may output the compensation data signal corresponding to 0 when the count signal is less than the value of the first operation time and the value of the second operation time.

In an embodiment, the display panel may be divided into a plurality of display blocks, and each of the first compensation data and the second compensation data may be individually set for each of the plurality of display blocks.

In an embodiment, the display device may further include a voltage generator which generates a plurality of reference voltages, and the data driving circuit may convert the data signal received from the image processor into gradation voltages based on the plurality of reference voltages and output the gradation voltages to the plurality of data lines.

In an embodiment, the control signal generation part may provide a voltage control signal corresponding to the compensation data from the memory to the voltage generator in response to the count signal, and the voltage generator may generate the plurality of reference voltages in response to the voltage control signal.

In an embodiment, the compensation data stored in the memory may further include voltage compensation data for setting a voltage level of the plurality of reference voltages, and the voltage compensation data may include first voltage compensation data corresponding to the first operation time and second voltage compensation data corresponding to the second operation time.

In an embodiment, the display device may further include a backlight unit which provides light to the display panel.

In an embodiment, the control signal generation part may provide a backlight control signal corresponding to the compensation data from the memory to the backlight unit in response to the count signal, and the backlight unit may adjust a brightness of the light in response to the backlight control signal.

In an embodiment, the display panel may be divided into a plurality of display blocks, and the backlight unit may be divided into a plurality of light emitting blocks, each corresponding to a display block of the plurality of display blocks.

In an embodiment, the backlight unit may adjust a brightness of light of each of the plurality of light emitting blocks in response to the backlight control signal.

In an embodiment, the compensation data stored in the memory may further include brightness compensation data for setting a brightness of each of the plurality of light emitting blocks, and the brightness compensation data may include first brightness compensation data corresponding to the first operation time and second brightness compensation data corresponding to the second operation time.

In an embodiment, the control signal may include a clock signal, and the timer may count the clock signal to output the count signal.

In an embodiment of the invention, a method for operating a display device includes: receiving an image signal and a control signal; counting a clock signal contained in the control signal and outputting a count signal; receiving first compensation data from a memory of the display device when the count signal reaches a first operation time and outputting a data signal obtained based on the first compensation data by combining the image signal and the first compensation data; and receiving second compensation data from the memory when the count signal reaches a second operation time which is different from the first operation time and outputting a data signal obtained based on the second compensation data by combining the image signal and the second compensation data.

In an embodiment, the method may further include changing a reference voltage of the display device based on the first compensation data when the count signal reaches the first operation time.

In an embodiment, the method may further include adjusting a brightness of light from a backlight unit of the display device based on the first compensation data when the count signal reaches the first operation time.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain principles of the invention. In the drawings.

DETAILED DESCRIPTION

Figure 1:
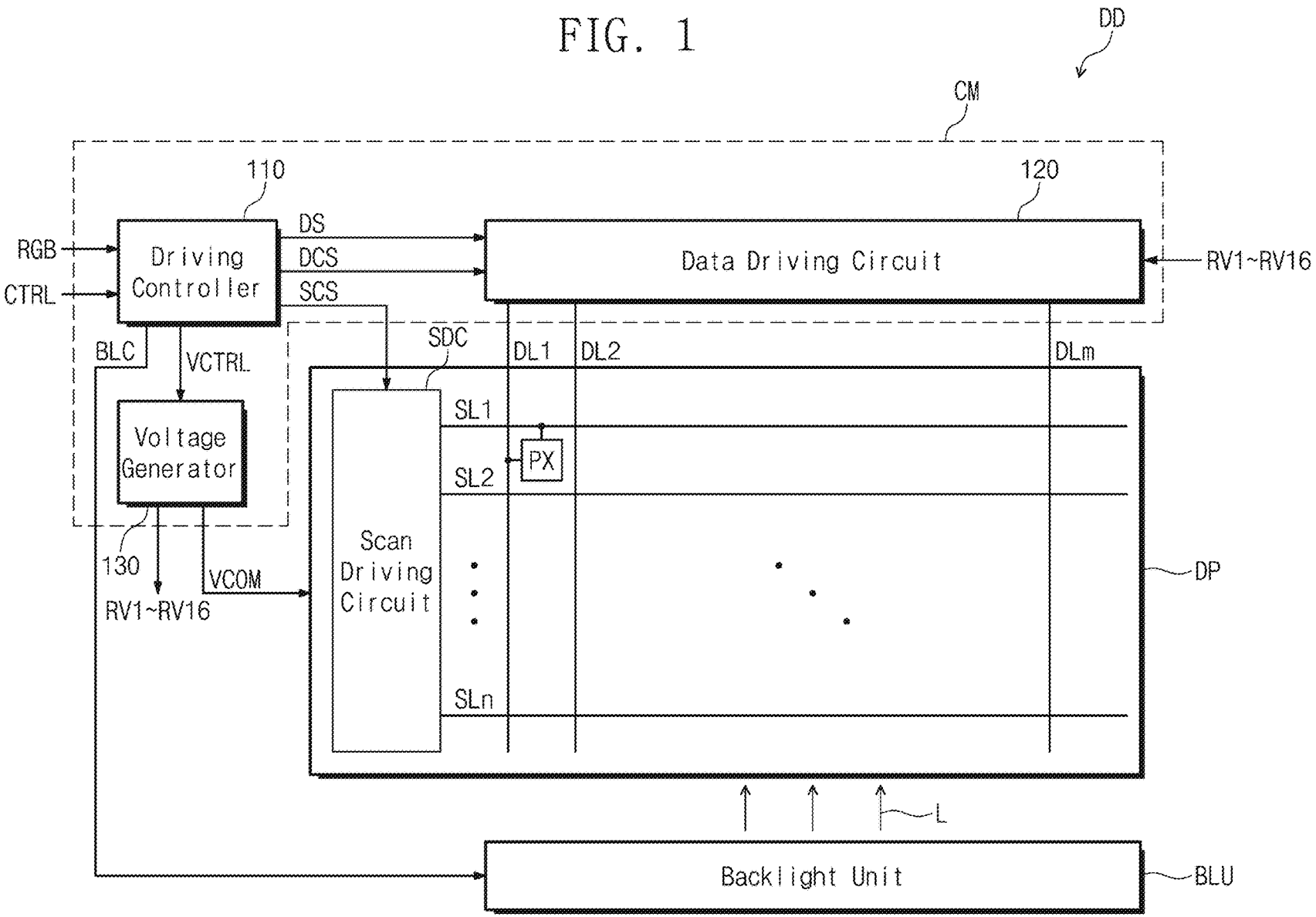
FIG. 1 is a block diagram illustrating a display device according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

In this specification, it will also be understood that when one component (or region, layer, portion) is referred to as being 'on', 'connected to', or 'coupled to' another component, it can be directly disposed/connected/coupled on/to the one component, or an intervening third component may also be present.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that although the terms such as 'first' and 'second' are used herein to describe various elements, these elements should not be limited by these terms. The terms are only used to distinguish one component from other components. For example, a first element referred to as a first element in one embodiment can be referred to as a second element in another embodiment without departing from the scope of the appended claims.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10% or 5% of the stated value.

Unless otherwise defined, all terms (including technical and scientific terms) used herein have the same meaning as generally understood by those skilled in the art. Terms as defined in a commonly used dictionary should be construed as having the same meaning as in an associated technical context, and unless defined apparently in the description, the terms are not ideally or excessively construed as having formal meaning.

Hereinafter, embodiments of the invention will be described in detail with reference to the accompanying drawings.

FIG. 1 is a block diagram illustrating a display device according to an embodiment of the invention.

Referring to FIG. 1, an embodiment of a display device DD includes a display panel DP, a control module CM, and a backlight unit BLU. The display panel DP includes a scan driving circuit SDC, a plurality of pixels PX, a plurality of data lines DL1 to DLm, and a plurality of scan lines SL1 to SLn. Each of the plurality of pixels PX is connected to a corresponding data line of the plurality of data lines DL1 to DLm and a corresponding scan line of the plurality of scan lines SL1 to SLn.

The display panel DP for displaying an image may be a liquid crystal display ("LCD") panel, an electrophoretic display panel, an organic light emitting diode ("OLED") panel, a light emitting diode ("LED") panel, an inorganic electro luminescent display ("EL)" panel, a field emission display ("FED") panel, a surface-conduction electron-emitter display ("SED") panel, a plasma display panel ("PDP"), or a cathode ray tube ("CRT"). Hereinafter, for convenience of description, embodiments where the display device is a liquid crystal display device will be described in detail, but the embodiment of the invention is not limited thereto. In an alternative embodiment, the display panel DP thereof may include at least one of various types of display panel.

The control module CM includes a driving controller 110, a data driving circuit 120, and a voltage generator 130.

The driving controller 110 receives an image signal RGB and a control signal CTRL for controlling display of the image signal RGB from an outside, e.g., an external device. In one embodiment, for example, the control signal CTRL may include at least one synchronization signal and at least one clock signal. The driving controller 110 provides a data signal DS, which is obtained by processing an image signal RGB to correspond to an operation condition of the display panel DP, to the data driving circuit 120. The driving controller 110 provides a first a first control signal DCS to the data driving circuit 120 and a second control signal SCS to the scan driving circuit SDC based on the control signal CTRL. The first control signal DCS may include a horizontal synchronization start signal, a clock signal and a line latch signal, and the second control signal SCS may include a vertical synchronization start signal and an output enable signal. The driving controller 110 may further output a voltage control signal VCTRL for controlling an operation of the voltage generator 130 and a backlight control signal BLC for controlling an operation of the backlight unit BLU.

The data driving circuit 120 may output gradation (or grayscale) voltages for driving the plurality of data lines DL1 to DLm in response to the first control signal DCS and the data signal DS from the driving controller 110. In an embodiment, the data driving circuit 120 may be realized as an integrated circuit ("IC") and directly mounted to a predetermined area of the display panel DP, or mounted to a separate circuit board in a chip on film ("COF") method and electrically connected to the display panel DP. In an alternative embodiment, the data driving circuit 120 may be provided through a same process as the driving circuit of the pixels PX on the display panel DP. In an embodiment, the data driving circuit 120 may output gradation voltages corresponding to the data signal DS based on first to sixteenth reference voltages RV1 to RV16 from the voltage generator 130.

The scan driving circuit SDC drives the plurality of scan lines SL1 to SLn in response to the second control signal SCS from the driving controller 110. In an embodiment, the scan driving circuit SDC may be provided on the display panel DP through a same process as the driving circuit of the pixels PX, but the embodiment of the invention is not limited thereto. In one embodiment, for example, the scan driving circuit SDC may be implemented as an IC and directly mounted to a predetermined area of the display panel DP or mounted to a separate circuit board in a COF method and electrically connected to the display panel DP.

The voltage generator 130 may provide a common voltage VCOM, which is used for an operation of the display panel DP, to the display panel DP. In one embodiment, for example, the voltage generator 130 generates the first to sixteenth reference voltages RV1 to RV16 in response to the voltage control signal VCTRL from the driving controller 110. The first to sixteenth reference voltages RV1 to RV16 are provided to the data driving circuit 120. The voltage generator 130 may further generate voltages used for operations of the driving controller 110 and the data driving circuit 120.

The data driving circuit 120 may generate gradation voltages corresponding to the data signal DS based on the first to sixteenth reference voltages RV1 to RV16 from the voltage generator 130 and output the generated gradation voltages to the data lines DL1 to DLm.

The backlight unit BLU may be disposed on a rear side of the display panel DP to provide light L to the display panel DP. In an embodiment, the backlight unit BLU may be disposed on the rear side of the display panel DP or at one side of the display panel DP. Although not shown in the drawing, the backlight unit BLU may include an optical sheet, a diffusion sheet, and a reflection member. The backlight unit BLU operates in response to a backlight control signal BLC from the driving controller 110. In one embodiment, for example, the backlight unit BLU may adjust light emitting brightness or perform a dimming operation in response to the backlight control signal BLC.

Figure 2:
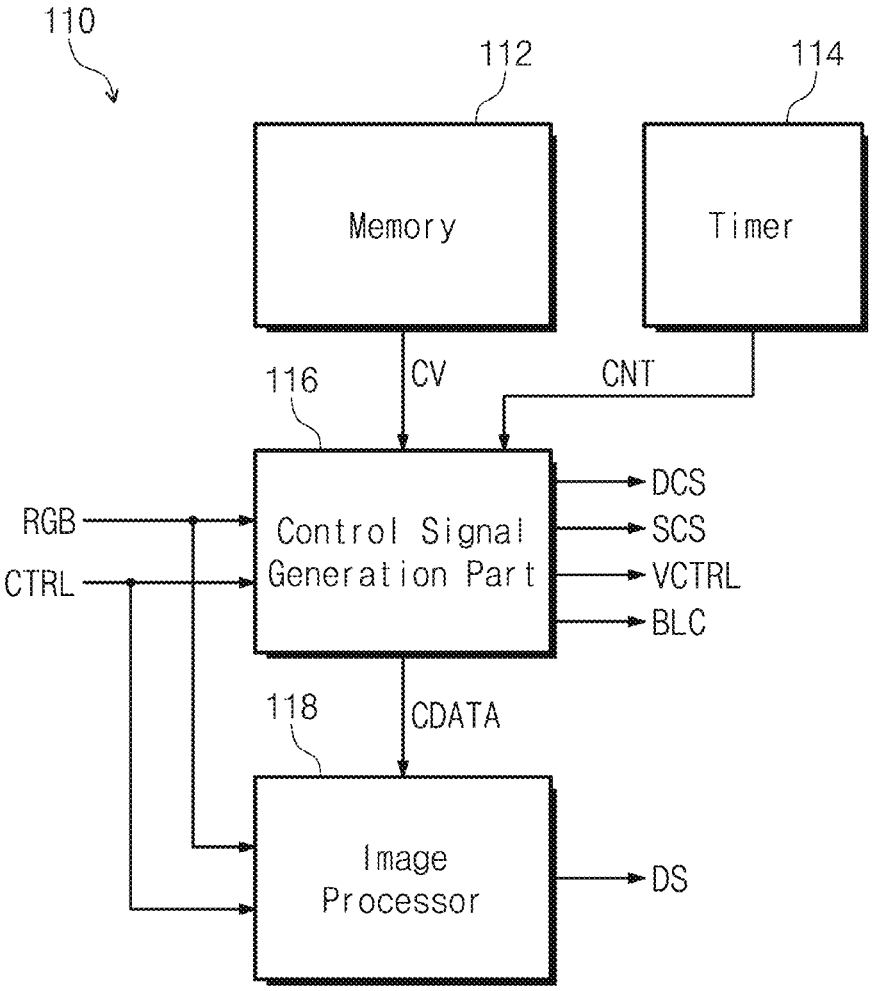
FIG. 2 is a block diagram illustrating a driving controller according to an embodiment of the invention.

FIG. 2 is a block diagram illustrating the driving controller 110 according to an embodiment of the invention.

In an embodiment, as illustrated in FIG. 2, the driving controller 110 includes a memory 112, a timer 114, a control signal generation part 116, and an image processor 118.

The memory 112 stores compensation data CV. The compensation data CV may include at least one of various data for preventing display quality degradation of the display panel DP (refer to FIG. 1). In one embodiment, for example, the compensation data CV may be gradation compensation data for changing the data signal DS provided to the data driving circuit 120. Alternatively, the compensation data CV may be voltage compensation data for changing the voltage control signal VCTRL provided to the voltage generator 130. In an embodiment, the compensation data CV may be brightness compensation data for changing the backlight control signal BLC provided to the backlight unit BLU. The compensation data CV may include at least one selected from data compensation data, voltage compensation data, and brightness compensation data.

The memory 112 may be a non-volatile memory (e.g., a flash memory), which maintains stored data even when a power is turned-off. The memory 112 may provide the compensation data CV to the control signal generation part 116 in response to a request from the control signal generation part 116.

In an embodiment, as shown in FIG. 2, the memory 112 may be provided or included in the driving controller 110, but the embodiment of the invention is not limited thereto. Alternatively, the memory 112 may be separately provided at the outside of the driving controller 110.

The timer 114 counts an operation time of the driving controller 110 (or the display device DD (refer to FIG. 1)) and outputs a count signal CNT based on the counted operation time. In one embodiment, for example, the timer 114 may perform a count-up operation after a power is turned-on. In an alternative embodiment, the timer 114 may be synchronized with one of a synchronization signal and a clock signal of the control signal CTRL to perform the count-up operation. Thus, the count signal CNT outputted from the timer 114 may count the operation time of the driving controller 110 (or the display device DD).

The control signal generation part 116 outputs the first control signal DCS, the second control signal SCS, the voltage control signal VCTRL, and the backlight control signal BLC in response to the control signal CTRL and the image signal RGB, which are provided from the outside, and in response to the compensation data CV received from the memory 112, and the count signal CNT received from the timer 114. In an embodiment, as described above with reference to FIG. 1, the first control signal DCS is provided to the data driving circuit 120, the second control signal SCS is provided to the scan driving circuit SDC, the voltage control signal VCTRL is provided to the voltage generator 130, and the backlight control signal BLC is provided to the backlight unit BLU.

The image processor 118 outputs the data signal DS in response to the image signal RGB, the control signal CTRL, and a compensation data signal CDATA. The data signal DS may be provided to the data driving circuit 120 in FIG. 1.

Figure 3:
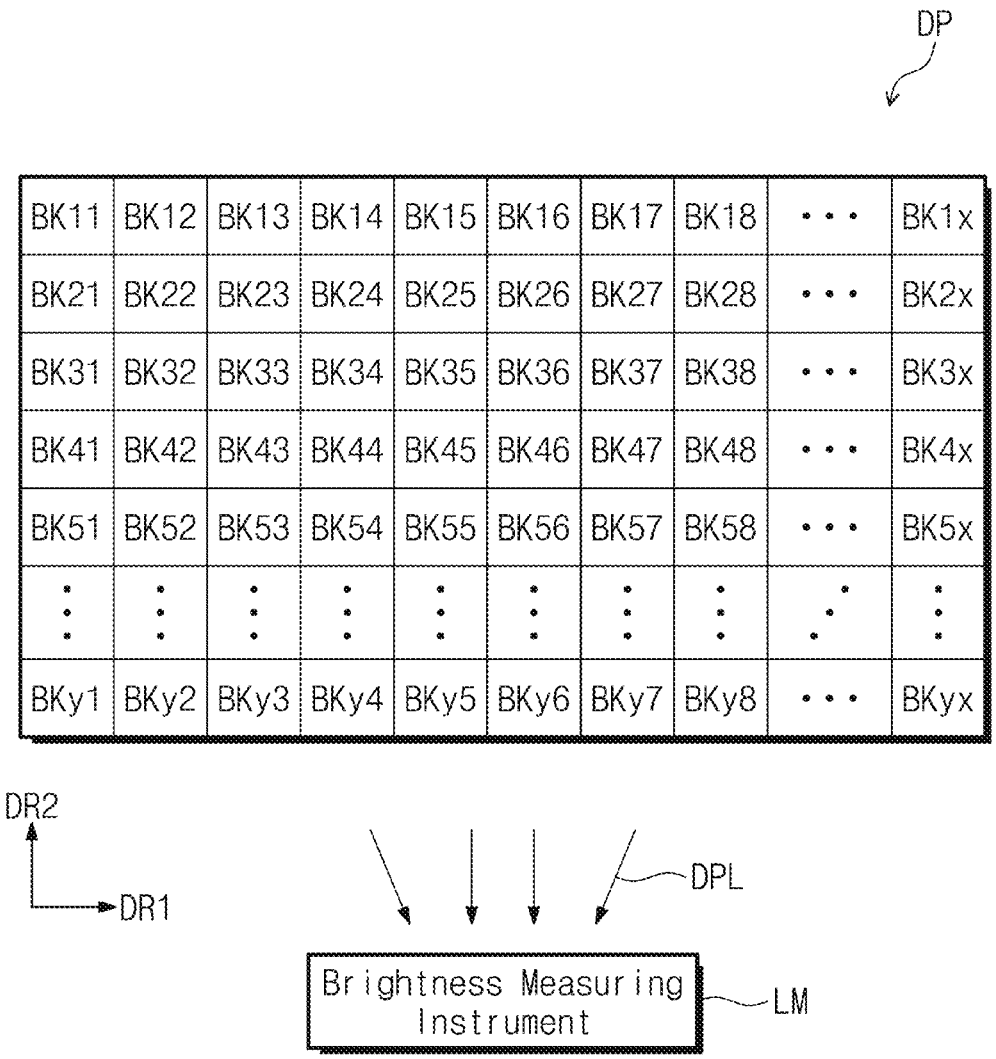
FIG. 3 is a view exemplarily illustrating a display panel that is divided into a plurality of display blocks.
Figure 4A:
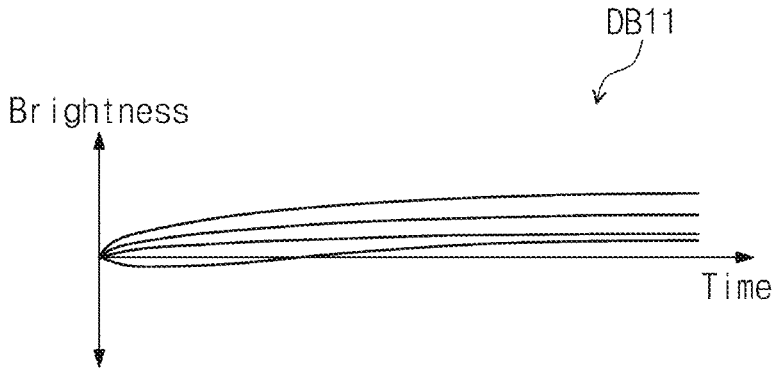
FIGS. 4A to 4D are views exemplarily illustrating a measurement result of some display blocks of the display panel.
Figure 4B:
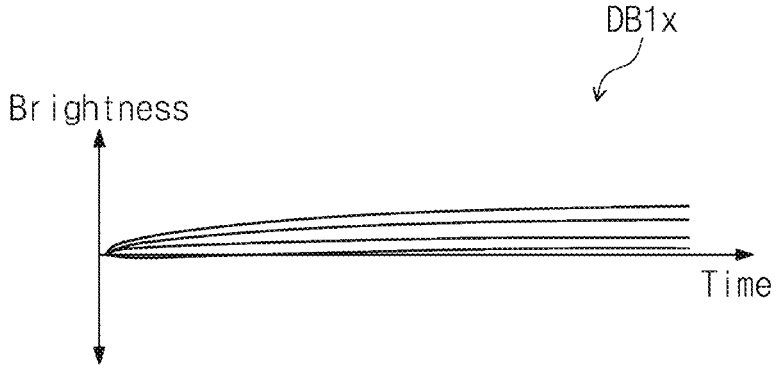
Figure 4C:
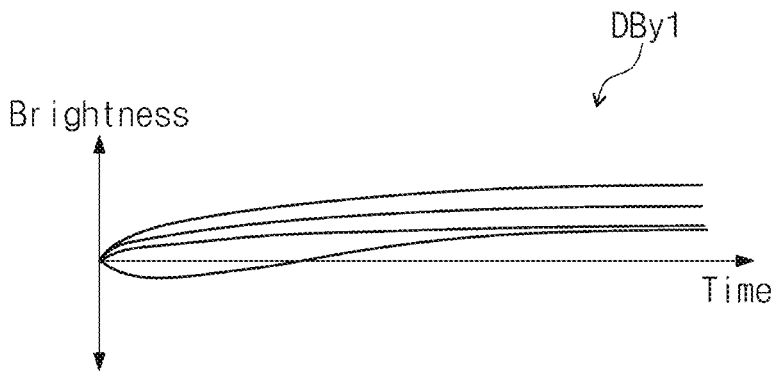
Figure 4D:
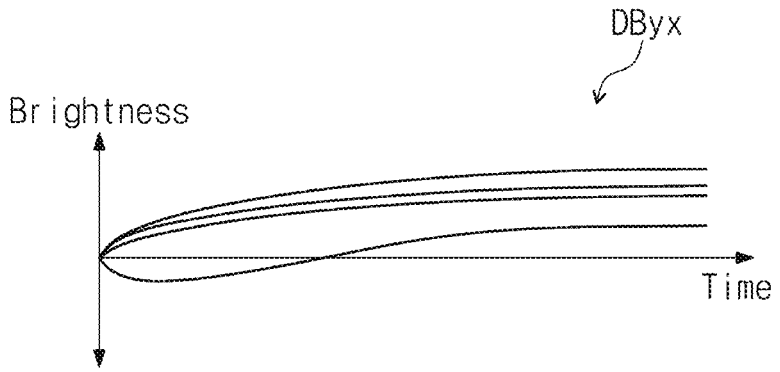

FIG. 3 is a view exemplarily illustrating the display panel that is divided into a plurality of display blocks.

Referring to FIG. 3, an embodiment of the display panel DP may be divided into display blocks BK11 to BKyx that are arranged with x-rows (extending in the first direction DR1) and y-columns (extending in the second direction DR2). Here, x and y are natural numbers. Each of the display blocks BK11 to BKyx may include a plurality of pixels PX (refer to FIG. 1).

In an embodiment of a process of manufacturing the display device DD (refer to FIG. 1), a brightness measuring instrument LM measures brightness of each of the display blocks BK11 to BKyx. In such an embodiment, the brightness measuring instrument LM measures a brightness variation of each of the display blocks BK11 to BKyx of the display panel DP as a time elapses and stores measured brightness information in an internal memory (not shown).

In an embodiment, the brightness measuring instrument LM may be a surface brightness measuring instrument. The brightness measuring instrument LM may measure a brightness of light DPL emitted from a front surface of the display panel DP and divide a measured result in a unit of the display blocks BK11 to BKyk and store the divided result in the internal memory (not shown).

FIGS. 4A to 4D are views exemplarily illustrating a measurement result of some display blocks of the display panel DP.

FIGS. 4A to 4D show a brightness variation of each of display blocks BK11, BK1*x*, BKy1, and BKyk of the display panel DP. For convenience of illustration, FIGS. 4A to 4D show only measured brightness variation of some display blocks BK11, BK1*x*, BKy1, and BKyk of the display blocks BK11 to BKyx in FIG. 3. In an embodiment, the brightness measuring instrument LM (refer to FIG. 3) may measure a brightness variation of all display blocks BK11 to BKyk.

Referring to FIG. 3 and FIGS. 4A to 4D, brightness of each of the display blocks BK11, BK1*x*, BKy1, and BKyk may vary as time elapses, but may be maintained when a predetermined time elapses. Thus, a brightness database of the display blocks BK11 to BKyk may be built by measuring the brightness variation of each of the display blocks BK11 to BKyk of various display devices.

The brightness variation of the display blocks BK11, BK1*x*, BKy1, and BKyk in FIGS. 4A to 4D may be stored in the brightness measuring instrument LM as database brightness data DB11, DB1*x*, DBy1, and DByx.

FIGS. 5A to 5D are views sequentially showing a process of predicting a brightness variation of a display block BK11 of the display panel DP by the brightness measuring instrument LM (refer to FIG. 3).

Figure 5A:
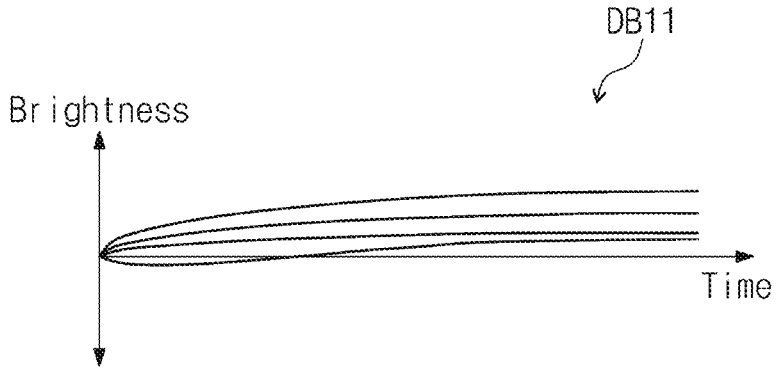
FIGS. 5A to 5D are views sequentially illustrating a process of predicting a brightness variation of a display block of the display panel by a brightness measuring instrument.

FIG. 5A shows the brightness variation of the display block BK11 of the display panel DP measured by the brightness measuring instrument LM. The brightness variation of the display block BK11 disposed at a same position in a plurality of display panels DP may be stored in the brightness measuring instrument LM as the database brightness data DB11. That is, the database brightness data DB11 that is obtained by measuring the brightness variation of the display block BK11 of various display devices for a long time is stored in the brightness measuring instrument LM.

Figure 5B:
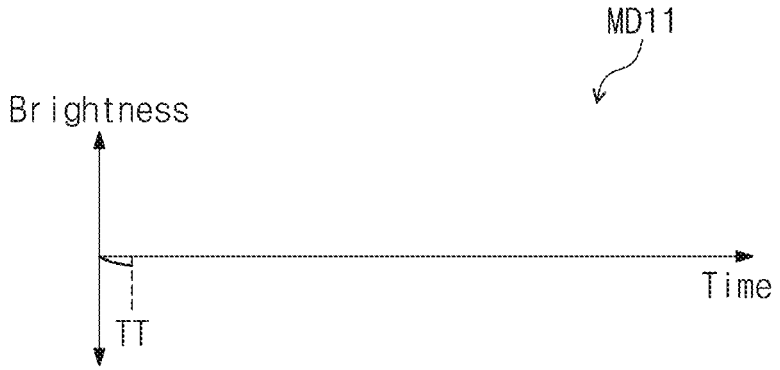

Referring to FIG. 5B, the brightness measuring instrument LM (refer to FIG. 3) measures the brightness variation of the display block BK11 of the display panel DP for a test time TT in a process of manufacturing the display device DD (refer to FIG. 1). In one embodiment, for example, the test time TT may be two hours, but the embodiment of the invention is not limited thereto. In an embodiment, the display device DD may be disposed under a specific environment (e.g., high temperature, etc.) for the test time TT.

Figure 5C:
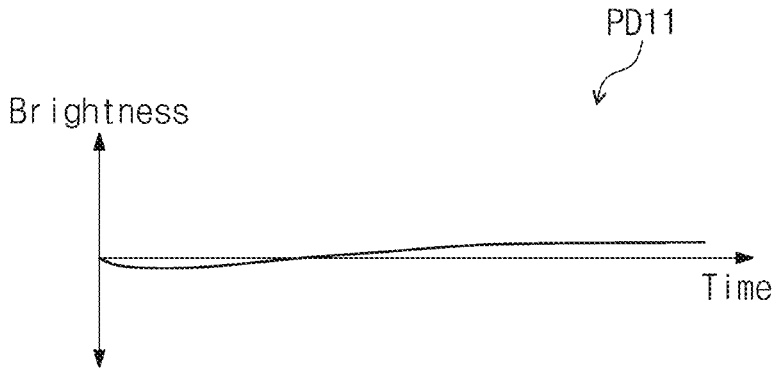

The brightness measuring instrument LM calculates prediction brightness data PD11 by comparing the brightness data MD11 measured during the test time TT and the database brightness data DB11 as illustrated in FIG. 5C. In one embodiment, for example, the brightness measuring instrument LM may select the database brightness data, which is the most similar to the brightness data MD11 measured during the test time TT, among the database brightness data DB11 illustrated in FIG. 5A, and calculate the prediction brightness data PD11 based on the selected database brightness data.

Figure 5D:
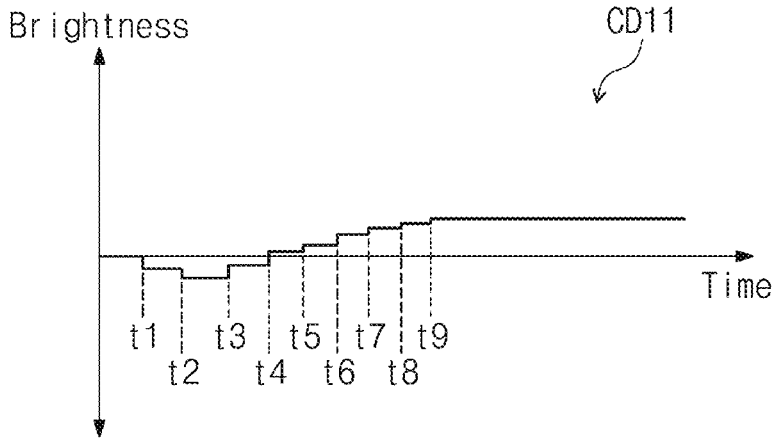

The brightness measuring instrument LM may calculate compensation data CD11 in FIG. 5D based on the prediction brightness data PD11. The compensation data CD11 may be set differently for each operation time t1 to t9.

FIGS. 6A to 6D are views sequentially showing a process of predicting a brightness variation of a display block BKyx of the display panel DP by the brightness measuring instrument LM (refer to FIG. 3).

Figure 6A:
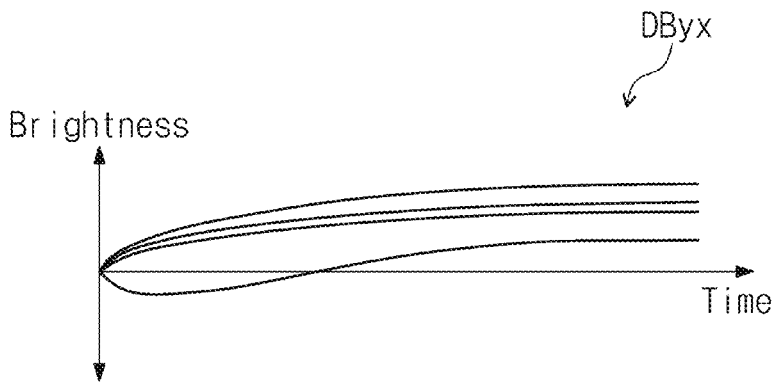
FIGS. 6A to 6D are views sequentially illustrating a process of predicting a brightness variation of the display block of the display panel by the brightness measuring instrument.

FIG. 6A shows the brightness variation of the display block BKyx of the display panel DP measured by the brightness measuring instrument LM. The brightness variation of the display block BKyx disposed at a same position in the plurality of display panels DP may be stored in the brightness measuring instrument LM as the database brightness data DByx. That is, the database brightness data DByx that is obtained by measuring the brightness variation of the display block BKyx of various display devices for a long time is stored in the brightness measuring instrument LM.

Figure 6B:
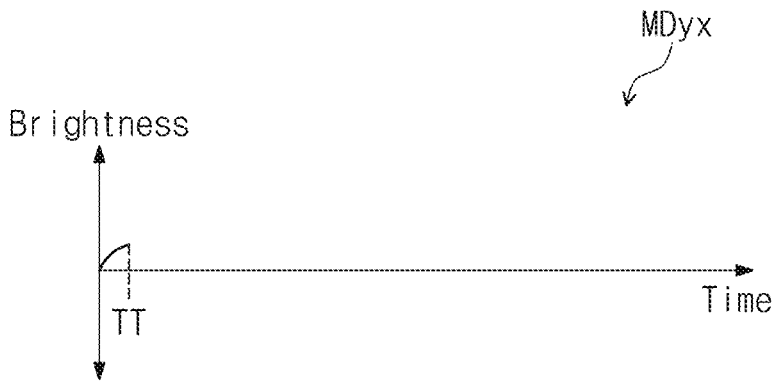

Referring to FIG. 6B, the brightness measuring instrument LM (refer to FIG. 3) measures the brightness variation of the display block BKyx of the display panel DP for the test time TT in the process of manufacturing the display device DD (refer to FIG. 1). In one embodiment, for example, the test time TT may be two hours, but the embodiment of the invention is not limited thereto. In an embodiment, the display device DD may be disposed under a specific environment (e.g., high temperature, etc.) for the test time TT.

Figure 6C:
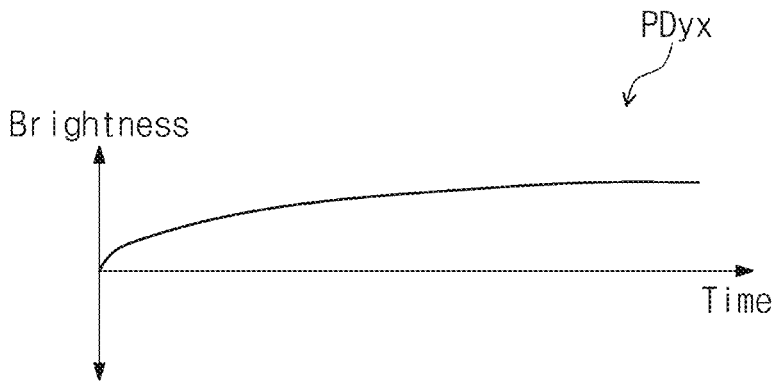

The brightness measuring instrument LM calculates prediction brightness data PD11 by comparing the brightness data MDyx measured during the test time TT and the database brightness data DByx as illustrated in FIG. 6C. In one embodiment, for example, the brightness measuring instrument LM may select the database brightness data DByx, which is the most similar to the brightness data MDyx measured during the test time TT, among the database brightness data DB11 illustrated in FIG. 6A, and calculate the prediction brightness data PDyx based on the selected database brightness data.

Figure 6D:
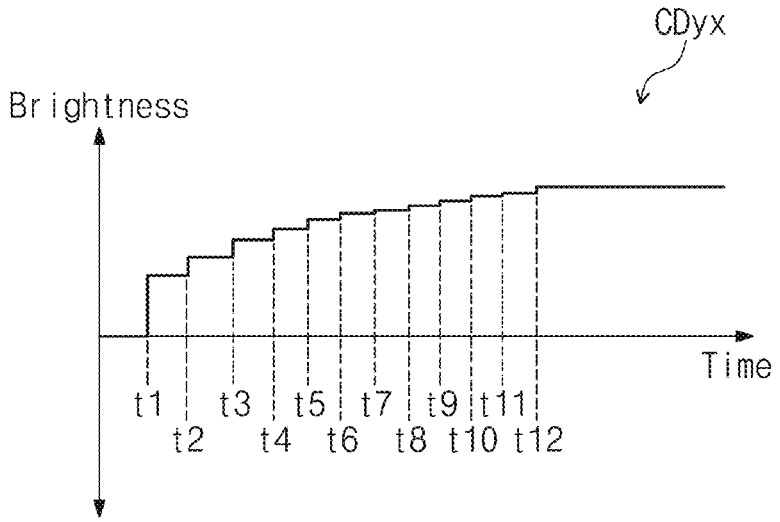

The brightness measuring instrument LM may calculate compensation data CDyx in FIG. 6D based on the prediction brightness data PDyx. The compensation data CDyx is determined for each operation time t1 to t11.

The compensation data CD11 in FIG. 5D include nine operation times t1 to t9, and the compensation data CDyx in FIG. 6*d* include eleven operation times t1 to t11. In an embodiment, as described above, the number of the operation times may be variously changed according to compensation data characteristics.

Figure 7:
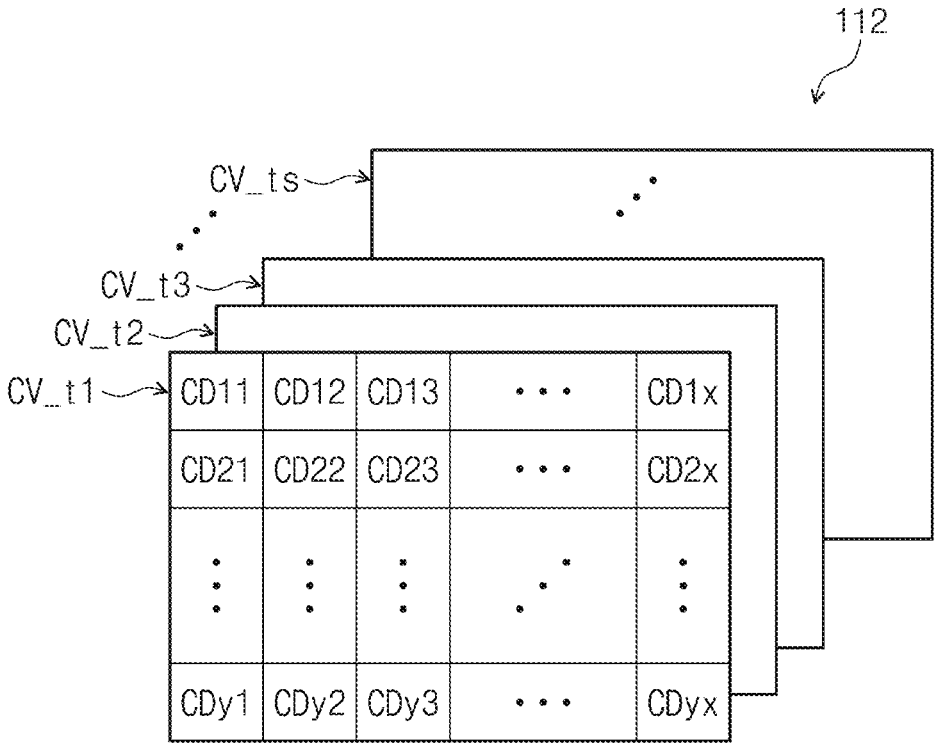
FIG. 7 is a view exemplarily illustrating compensation data stored in a memory in FIG. 2.

FIG. 7 is a view exemplarily illustrating the compensation data stored in the memory 112 in FIG. 2.

Referring to FIGS. 2 and 7, the compensation data stored in the memory 112 include compensation data groups CV_t1 to CV_ts corresponding to operation times t1 to ts, respectively. Here, each of operation times t1 to ts may have a value or a time value. Each of the compensation data groups CV_t1 to CV_ts includes the compensation data CD11 to CDyx corresponding to the display blocks BK11 to BKyx in FIG. 3. The compensation data CD11 to CDyx include values calculated by the method described above with reference to FIGS. 5A to 6D. A first compensation data group CV_t1 may be first compensation data corresponding to a first operation time, a second compensation data group CV_t2 may be second compensation data corresponding to a second operation time, and a s-th compensation data group CV_ts may be s-th compensation data corresponding to a s-th operation time (here, s is a natural number). In such an embodiment, the first operation time, the second operation time and the s-th operation time have different values from each other, the first operation time is longer (greater) than the second operation time, and the second operation time is longer (greater) than the s-th operation time.

The timer 114 counts an operation time of the driving controller 110 (or the display device DD (refer to FIG. 1)) and outputs a count signal CNT.

When the count signal CNT at the beginning is less than the first operation time t1, the control signal generation part 116 may provide the compensation data signal CDATA corresponding to '0' to the image processor 118. The initial compensation data signal CDATA may be variously set based on characteristics of the display panel DP. In one embodiment, for example, at the beginning, the control signal generation part 116 may output the initial compensation data signal CDATA so that a brightness of display blocks at a predetermined position among the display blocks BK11 to BKyx increases or decreases.

When the count signal CNT reaches the first operation time t1, i.e., when the count signal CNT is greater than the first operation time t1, the control signal generation part 116 receives the compensation data CD11 to CDyx of the first compensation data group CV_t1 as the compensation data CV from the memory 112. The control signal generation part 116 may provide the compensation data signal CDATA corresponding to the compensation data CD11 to CDyx of the first compensation data group CV_t1 to the image processor 118.

When the count signal CNT reaches the second operation time t2, i.e., when the count signal CNT is greater than the second operation time t2, the control signal generation part 116 receives the compensation data CD11 to CDyx of the second compensation data group CV_t2 as the compensation data CV from the memory 112. The control signal generation part 116 may provide the compensation data signal CDATA corresponding to the compensation data CD11 to CDyx of the second compensation data group CV_t2 to the image processor 118.

When the count signal CNT reaches the s-th operation time ts, i.e., when the count signal CNT is greater than the s-th operation time ts, the control signal generation part 116 receives the compensation data CD11 to CDyx of the s-th compensation data group CV_ts as the compensation data CV from the memory 112. The control signal generation part 116 may provide the compensation data signal CDATA corresponding to the compensation data CD11 to CDyx of the s-th compensation data group CV_ts to the image processor 118. After the s-th operation time ts, the control signal generation part 116 may provide the compensation data signal CDATA corresponding to the compensation data CD11 to CDyx of the s-th compensation data group CV_ts to the image processor 118.

Figure 8:
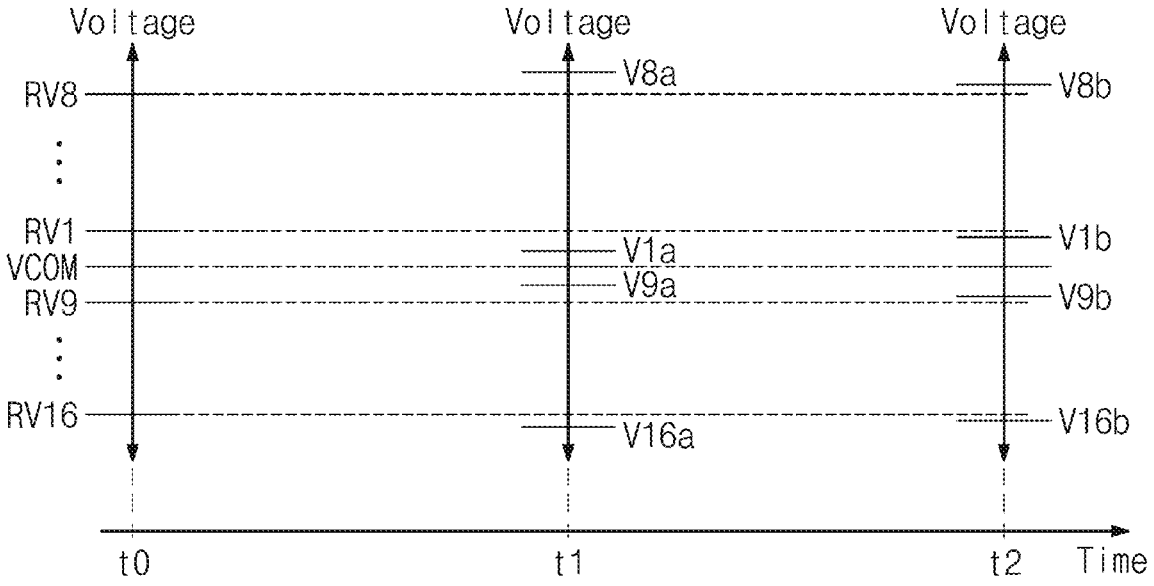
FIG. 8 is a view exemplarily illustrating first to sixteenth reference voltages generated from a voltage generator in FIG. 1.

FIG. 8 is a view exemplarily illustrating the first to sixteenth reference voltages RV1 to RV16 generated from the voltage generator 130 in FIG. 1.

Referring to FIGS. 1, 2, and 8, an embodiment of the voltage generator 130 outputs the first to sixteenth reference voltages RV1 to RV16, each having a preset voltage level, and a common voltage VCOM at the beginning t0 at which a user initially uses the display device DD.

In an embodiment, each of the first to eighth reference voltages RV1 to RV8 may have a voltage level greater than the common voltage VCOM, and be positive reference voltage. In such an embodiment, each of the ninth to sixteenth reference voltages RV9 to RV16 may have a voltage level less than the common voltage VCOM, and be negative reference voltage.

The compensation data CV stored in the memory 112 may be voltage compensation data generated based on the prediction brightness data PD11 and PDyx obtained by the method described above with reference to FIGS. 5A to 5C and 6A to 6C.

When the count signal CNT reaches the first operation time t1, i.e., when the count signal CNT is greater than the first operation time t1, the control signal generation part 116 receives the first compensation data as the compensation data CV from the memory 112. The control signal generation part 116 outputs the voltage control signal VCTRL for controlling the first to sixteenth reference voltages RV1 to RV16 to have voltage levels V1*a* to V16*a*, respectively.

In an embodiment, the voltage generator 130 generates the first to sixteenth reference voltages RV1 to RV16 having the voltage levels V1*a* to V16*a*, respectively, in response to the voltage control signal VCTRL.

When the count signal CNT reaches the second operation time t2, i.e., when the count signal CNT is greater than the second operation time t2, the control signal generation part 116 receives the second compensation data as the compensation data CV from the memory 112. In an embodiment, the control signal generation part 116 outputs the voltage control signal VCTRL for controlling the first to sixteenth reference voltages RV1 to RV16 to have voltage levels V1*b* to V16*b*, respectively.

The voltage generator 130 may generate the first to sixteenth reference voltages RV1 to RV16 having the voltage levels V1*b* to V16*b*, respectively, in response to the voltage control signal VCTRL.

Figure 9:
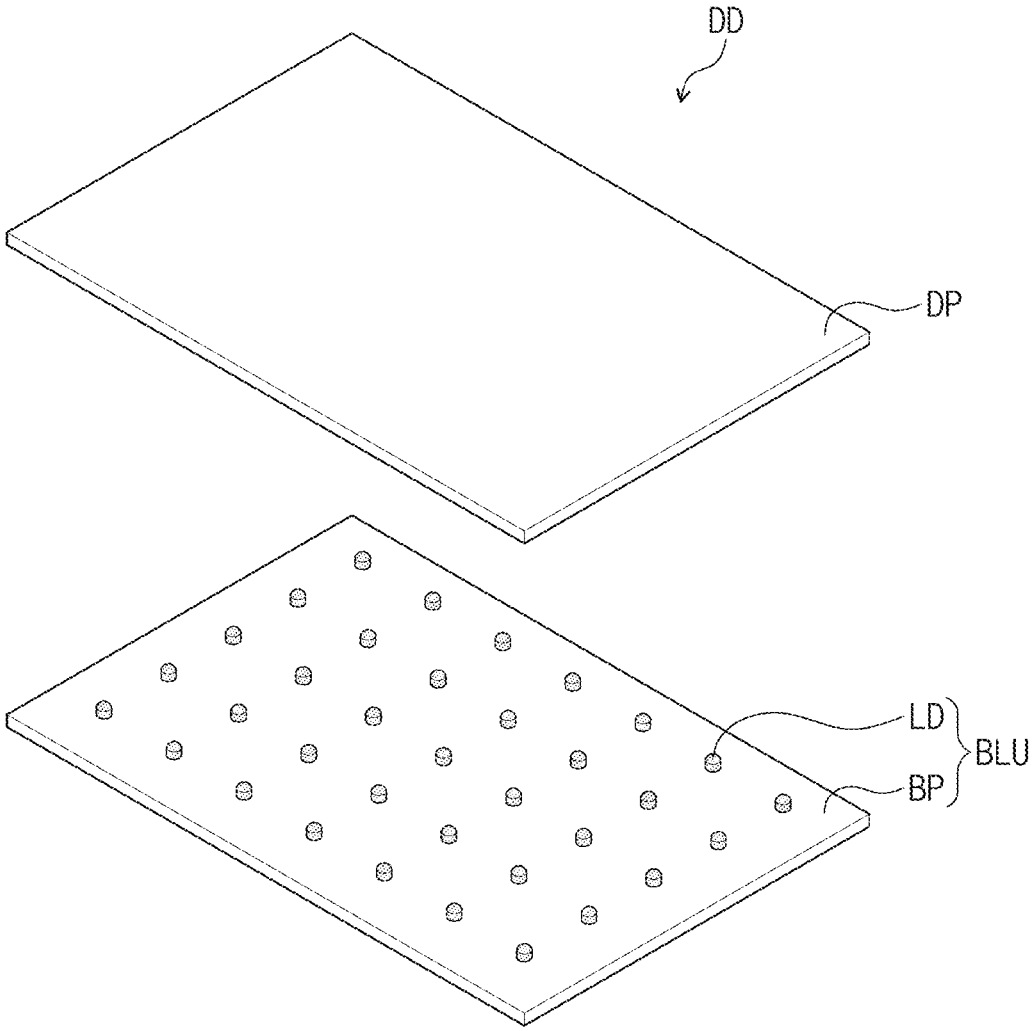
FIG. 9 is a view exemplarily illustrating the display panel and a backlight unit of the display device.

FIG. 9 is a view exemplarily illustrating the display panel DP and the backlight unit BLU of the display device DD.

Referring to FIG. 9, an embodiment of the backlight unit BLU may be disposed on a rear surface of the display panel DP and provide light to the display panel DP. In an embodiment, as described above, the backlight unit is disposed on the rear surface of the display panel, but the embodiment of the invention is not limited thereto. In one alternative embodiment, for example, the backlight unit BLU may be disposed at a side of the display panel DP.

The backlight unit BLU may include a light source panel BP and a plurality of light emitting units LU. The light source panel BP may support the plurality of light emitting units LU and transmit a voltage and various signals to the plurality of light emitting units LU. In an embodiment, the light source panel BP may have a rectangular plate shape. In one embodiment, for example, the light source panel BP may be a glass substrate having a small thermal deformation. However, the embodiment of the invention is not limited thereto. In one alternative embodiment, for example, the light source panel BP may include a transparent synthetic resin substrate having a high heat resistance.

The plurality of light emitting units LU may be disposed or mounted on a circuit board PCB. The light emitting units LU may receive a voltage from an outside and generate light to be provided to the display panel DP. The plurality of light emitting units LU may be disposed on a same plane. In an embodiment, each of the plurality of light emitting units LU may include an LED, but the embodiment of the invention is not limited thereto. In such an embodiment, each of the plurality of light emitting units LU may include any element capable of emitting light. In an embodiment, as shown in FIG. 9, the plurality of light emitting units LU may be arranged in a matrix form, but the embodiment of the invention is not limited thereto. In one embodiment, for example, the arrangement form may be variously modified based on the shape and size of the display panel DP.

Each of the plurality of light emitting units LU may emit blue light. In an embodiment, each of the plurality of light emitting units LU may be a blue LED including a gallium nitride based semiconductor, for example, but the embodiment of the invention is not limited thereto. In such an embodiment, each of the plurality of light emitting units LU may include any element for emitting blue light.

In an embodiment, each of the plurality of light emitting units LU may include a top emitting type lens. In such an embodiment, light generated from each of the plurality of light emitting units LU may be emitted in an upward direction of the plurality of light emitting units LU. In In such an embodiment, the backlight unit BLU may be a top view type backlight assembly.

Although not shown in the drawing, an optical sheet, a reflection member, and a diffusion plate may be further disposed between the display panel DP and the backlight unit BLU. The optical sheet may modulate optical characteristics of light emitted from the light emitting units LU. The reflection member may control a path of the light emitted from the light emitting units LU. The diffusion plate may serve to improve a brightness uniformity of the light emitted from the light emitting units LU.

Figure 10:
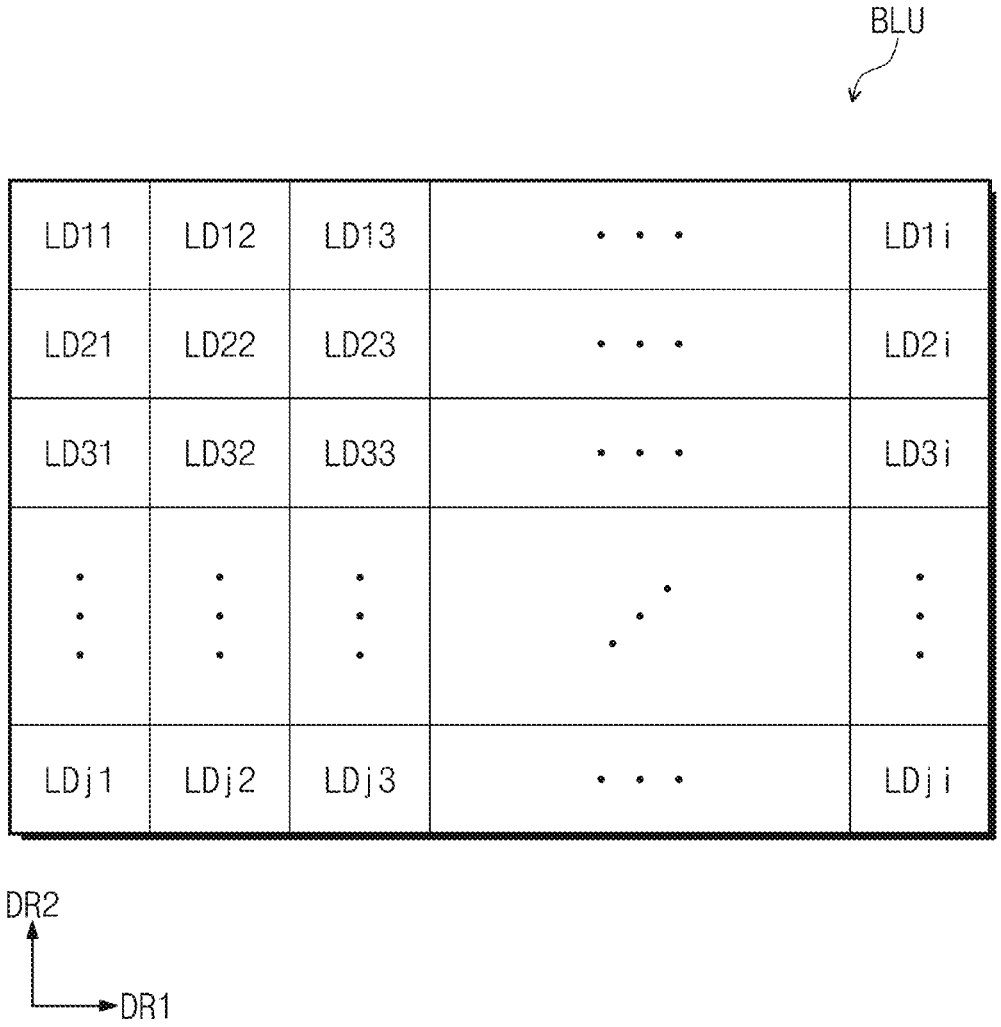
FIG. 10 is a view exemplarily illustrating the backlight unit that is divided into a plurality of light emitting blocks.

FIG. 10 is a view exemplarily illustrating the backlight unit BLU divided into a plurality of light emitting blocks.

Referring to FIG. 10, an embodiment of the backlight unit BLU may be divided into light emitting blocks LD11 to LDji that are arranged with i-rows (extending in the first direction DR1) and j-columns (extending in the second direction DR2). Each of the light emitting blocks LD11 to LDji may correspond to at least one of the plurality of light emitting units LU in FIG. 9. In one embodiment, for example, each of the light emitting blocks LD11 to LDji may correspond to (or defined by) two or more light emitting units of the plurality of light emitting units LU.

The light emitting blocks LD11 to LDji may correspond to the display blocks BK11 to BKyx of the display panel DP in FIG. 3, respectively. In one embodiment, for example, the light emitting blocks LD11 to LDji may be in a one-to-one correspondence with the display blocks BK11 to BKyx, respectively. In an alternative embodiment, each of the light emitting blocks LD11 to LDji may correspond to two or more display blocks of the display blocks BK11 to BKyx. In this case, $i<x$ and $j<y$.

Referring to FIGS. 2 and 10, the compensation data CV stored in the memory 112 may be brightness compensation data generated based on the prediction brightness data PD11 and PDyx obtained by the method described above with reference to FIGS. 5A to 5C and 6A to 6C.

When the count signal CNT reaches the first operation time t1, i.e., when the count signal CNT is greater than the first operation time t1, the control signal generation part 116 receives the brightness compensation data as the compensation data CV from the memory 112. The control signal generation part 116 outputs the backlight control signal BLC for controlling an operation of the backlight unit BLU based on the compensation data CV.

The backlight unit BLU may control the light emitting blocks LD11 to LDji in response to the backlight control signal BLC. The backlight unit BLU may control a brightness and a dimming time of each of the light emitting blocks LD11 to LDji in response to the backlight control signal BLC.

In an embodiment, when it is determined that a brightness of one group of display blocks of the display blocks BK11 to BKyx of the display panel DP decreases as an operation time of the display device DD elapses, for example, brightness compensation data for increasing a brightness of one group of light emitting blocks corresponding to the one group of display blocks of the light emitting blocks LD11 to LDji may be stored in the memory 112. In this case, the control signal generation part 116 outputs the backlight control signal BLC for increasing the brightness of the one group of light emitting blocks of the backlight unit BLU based on the compensation data CV from the memory 112.

In such an embodiment, when it is determined that a brightness of the other group of display blocks of the display blocks BK11 to BKyx of the display panel DP increases as the operation time of the display device DD elapses, for example, brightness compensation data for decreasing a brightness of the other group of light emitting blocks corresponding to the other group of display blocks of the light emitting blocks LD11 to LDji may be stored in the memory 112. In this case, the control signal generation part 116 outputs the backlight control signal BLC for decreasing the brightness of the other group of light emitting blocks of the backlight unit BLU based on the compensation data CV from the memory 112.

Through the above-described method, the brightness of each of the light emitting blocks LD11 to LDji of the backlight unit BLU may be adjusted based on a brightness variation of each of the display blocks BK11 to BKyx of the display panel DP.

Figure 11:
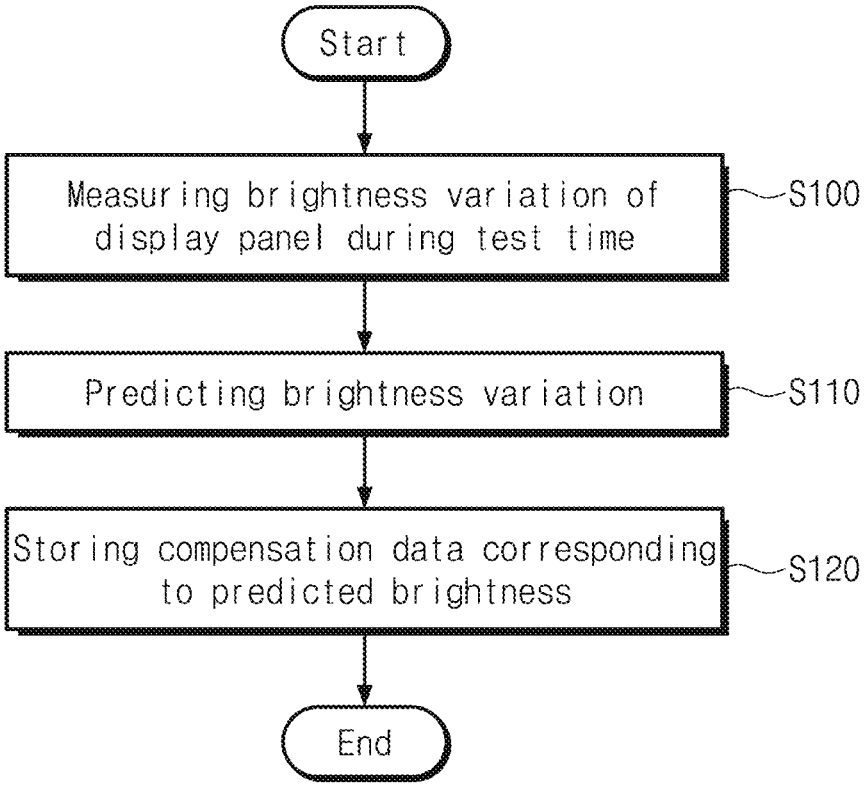
FIG. 11 is a flowchart showing a process of predicting a brightness variation of the display device.

FIG. 11 is a flowchart showing a process of predicting a brightness variation of the display device.

Referring to FIGS. 2, 3, and 11, the brightness measuring instrument LM measures a brightness of the display panel DP for the test time TT (refer to FIG. 5B) (S100).

In an embodiment, the brightness measuring instrument LM may individually measure a brightness of each of the display blocks BK11 to BKyx of the display panel DP. Alternatively, as described above, a brightness variation of each of the rest display blocks may be predicted by a same method.

The brightness measuring instrument LM compares brightness data MD11 (refer to FIG. 5B) measured during the test time TT with database brightness data DB11 and predicts the brightness variation of the display block BK11 of the display panel DP after the test time TT (S110). In one embodiment, for example, the brightness measuring instrument LM may select the database brightness data, which is the most similar to the brightness data MD11 measured during the test time TT, among the database brightness data DB11 illustrated in FIG. 5A and calculate the prediction brightness data PD11 based on the selected database brightness data as illustrated in FIG. 5C.

The brightness measuring instrument LM may calculate compensation data CD11 in FIG. 5D based on the prediction brightness data PD11. The compensation data CD11 may be set differently for each operation time t1 to t9. The compensation data CD11 is stored in the memory 112 (S120).

Figure 12:
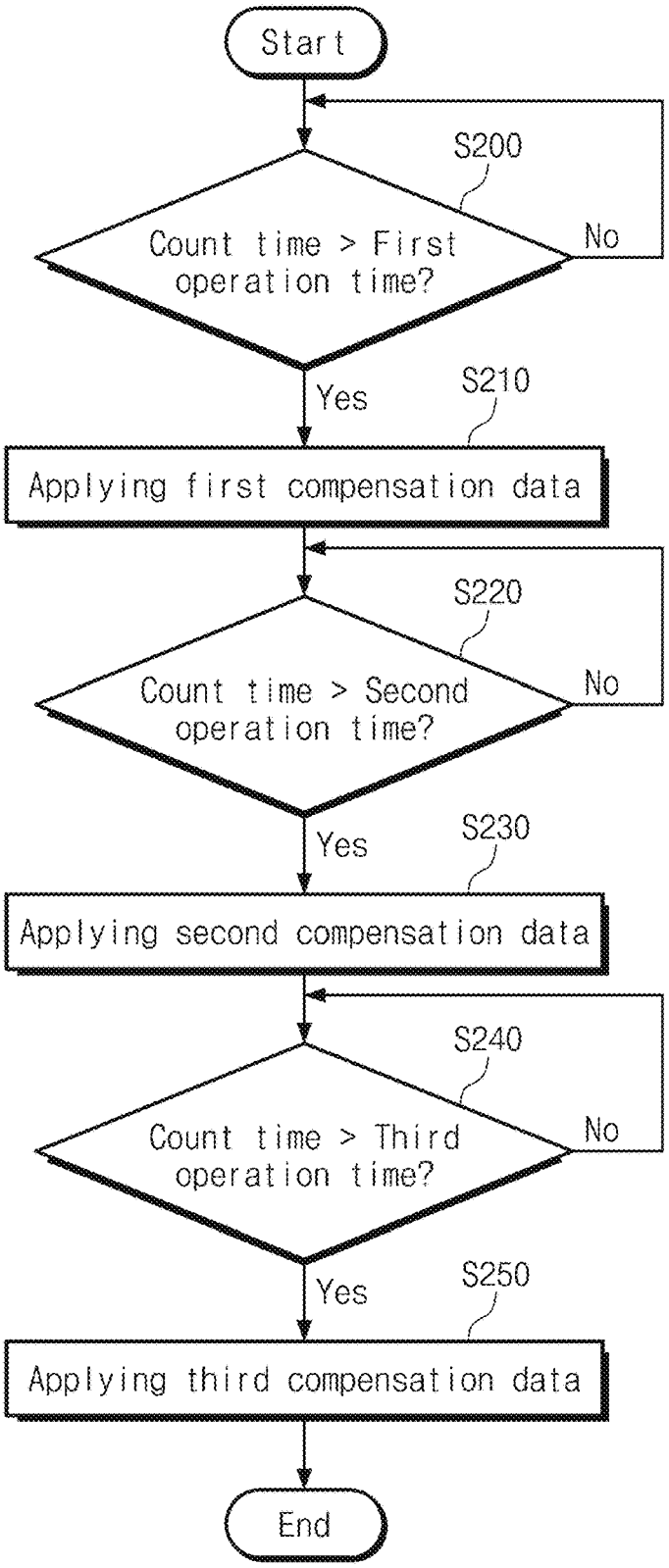
FIG. 12 is a flowchart showing an operation of the display device.

FIG. 12 is a flowchart showing an operation of the display device.

Hereinafter, an operation of an embodiment of the display device DD described above with reference to FIGS. 1 and 2 will be described in detail for convenience of description.

Referring to FIGS. 1, 2, and 12, in an embodiment, the control signal generation part 116 receives the image signal RGB and the control signal CTRL from an outside. The timer 114 counts a clock signal contained in the control signal CTRL and outputs the count signal CNT.

When the count signal CNT reaches the first operation time t1 (refer to FIG. 5D), when i.e., the count signal CNT is greater than the first operation time t1 (S200), the control signal generation part 116 receives a first compensation data as the compensation data CV from the memory 112. In an embodiment, as described above, the compensation data CV may include at least one selected from various data for preventing the display quality degradation of the display panel DP (refer to FIG. 1). In one embodiment, for example, the compensation data CV may be gradation compensation data for changing the data signal DS provided to the data driving circuit 120. The compensation data CV may be voltage compensation data for changing the voltage control signal VCTRL provided to the voltage generator 130. In an embodiment, the compensation data CV may be brightness compensation data for changing the backlight control signal BLC provided to the backlight unit BLU. The compensation data CV may include at least one selected from the data compensation data, the voltage compensation data, and the brightness compensation data.

The first compensation data may be compensation data corresponding to the first operation time t1 and the compensation data CD11 to CDyx of the first compensation data group CV_t1 in FIG. 7.

The control signal generation part 116 may change at least one of the compensation data signal CDATA, the voltage control signal VCTRL, and the backlight control signal BLC in correspondence to the first compensation data (S210).

When the count signal CNT reaches the second operation time t2 (refer to FIG. 5D), i.e., when the count signal CNT is greater than the second operation time t2 (S220), the control signal generation part 116 receives a second compensation data as the compensation data CV from the memory 112. The second compensation data may be compensation data corresponding to the second operation time t2 and the compensation data CD11 to CDyx of the second compensation data group CV_t2 in FIG. 7.

The control signal generation part 116 may change at least one of the compensation data signal CDATA, the voltage control signal VCTRL, and the backlight control signal BLC in correspondence to the second compensation data (S230).

When the count signal CNT reaches the third operation time t3 (refer to FIG. 5D), i.e., when the count signal CNT is greater than the third operation time t3 (S240), the control signal generation part 116 receives a third compensation data as the compensation data CV from the memory 112. The third compensation data may be compensation data corresponding to the third operation time t3 and the compensation data CD11 to CDyx of the third compensation data group CV_t3 in FIG. 7.

The control signal generation part 116 may change at least one selected from the compensation data signal CDATA, the voltage control signal VCTRL, and the backlight control signal BLC in correspondence to the third compensation data (S250). Although FIG. 12 illustrates a case until the count signal CNT is greater than the third operation time t3, the embodiment of the invention is not limited thereto.

Figure 13:
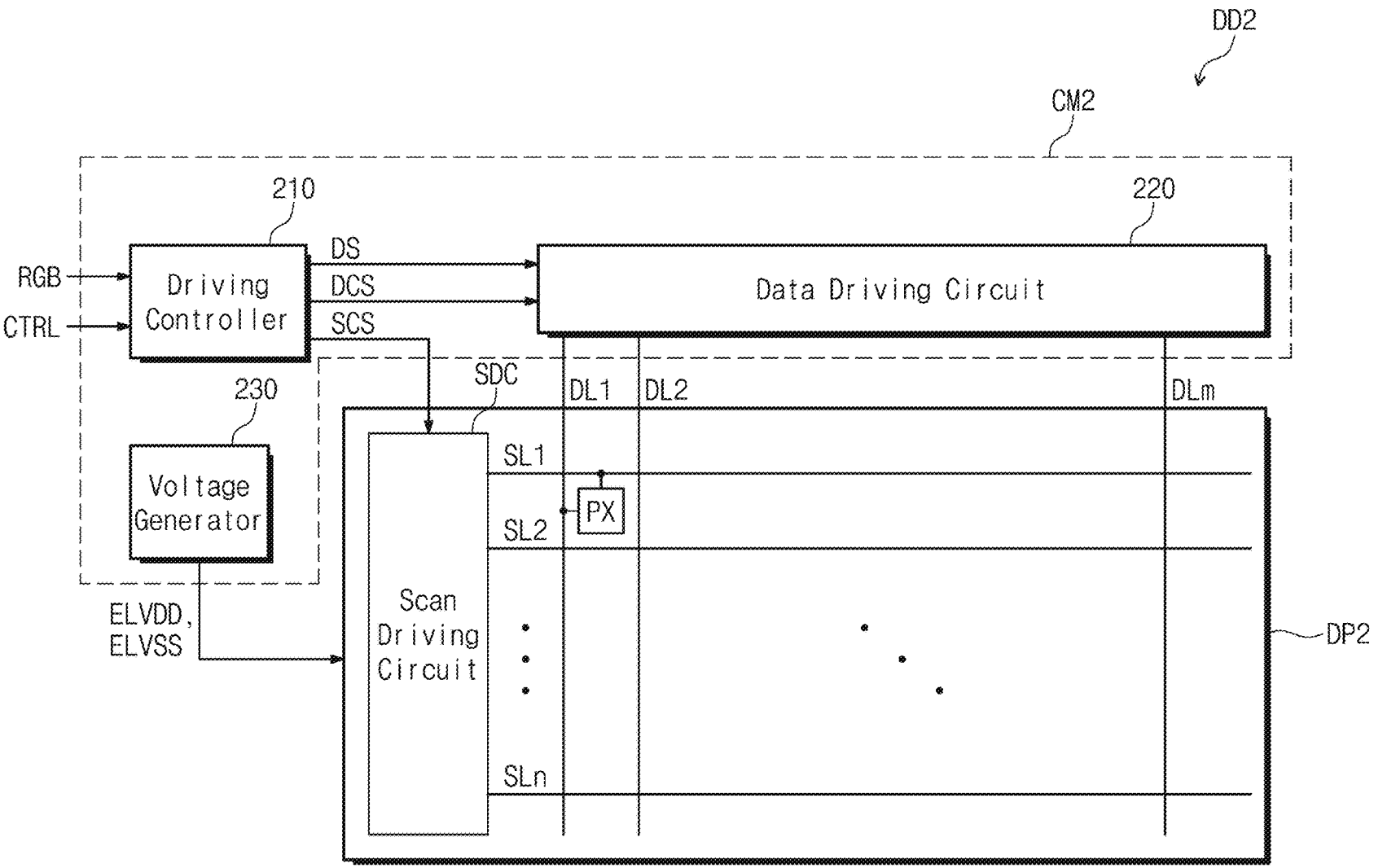
FIG. 13 is a view exemplarily illustrating a display device according to an alternative embodiment of the invention.

FIG. 13 is a view exemplarily illustrating a display device according to an alternative embodiment of the invention.

Referring to FIG. 13, an embodiment of a display device DD2 includes a display panel DP2 and a control module CM2. In such an embodiment, the display panel DP2 may be an OLED panel or an LED panel, which does not require a light source (backlight unit).

The control module CM2 includes a driving controller 210, a data driving circuit 220, and a voltage generator 230.

The driving controller 210 receives an image signal RGB and control signal CTRL for controlling display of the image signal from the outside. The driving controller 210 provides data signal DS obtained by processing the image signal RGB to correspond to an operation condition of the display panel DP2 to the data driving circuit 220. The driving controller 210 provides a first control signal DCS to the data driving circuit 220 and a second control signal SCS to a scan driving circuit SDC based on the control signal CTRL.

The data driving circuit 220 may output gradation voltages for driving a plurality of data lines DL1 to DLm in response to the first control signal DCS and the data signal DS from the driving controller 210.

The scan driving circuit SDC drives a plurality of scan lines SL1 to SLn in response to the second control signal SCS from the driving controller 210.

The voltage generator 230 may provide driving voltages ELVDD and ELVSS used for an operation of the display panel DP2 to the display panel DP2.

The driving controller 210 may have a configuration similar to that of the driving controller 110 in FIG. 2. The compensation data CV stored in a memory 112 of the driving controller 210 may be gradation compensation data for changing the data signal DS provided to the data driving circuit 120.

The driving controller 210 reads the compensation data CV corresponding to an operation time of the display device DD from the memory 112. The driving controller 210 outputs the data signal DS obtained by compensating the image signal RGB based on the compensation data CV. The data signal DS may be provided to the data driving circuit 220.

In such an embodiment, the display device may measure and predict the state variation of the display panel and store the compensation data corresponding to the predicted result in a production process. The display device may display the image by applying the compensation data according to the operation time. Thus, the display quality degradation of the display device may be effectively prevented.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A driving controller comprising:

a timer which counts an operation time and outputs a count signal;

a memory which stores first compensation data corresponding to a first operation time and second compensation data corresponding to a second operation time, which is different from the first operation time, wherein the first compensation data and the second compensation data correspond to a predicted result in a production process, and each of the first compensation data and the second compensation data is individually set for each of a plurality of display blocks of a display panel;

a control signal generation part which receives one of the first compensation data and the second compensation data as compensation data from the memory in response to the count signal and outputs compensation data signals based on the compensation data, wherein the compensation data signals correspond to the plurality of display blocks, respectively; and an image processor which converts an image signal into a data signal, and outputs the data signal, wherein the data signal is obtained by combining the image signal and a compensation data signal corresponding to each of the plurality of display blocks, and wherein each of the plurality of display blocks comprises a plurality of pixels.

2. The driving controller of claim 1, wherein the second operation time has a value greater than a value of the first operation time, the control signal generation part receives the first compensation data from the memory as the compensation data when the count signal is greater than the value of the first operation time and less than the value of the second operation time, and the control signal generation part receives the second compensation data from the memory as the compensation data when the count signal is greater than the value of the second operation time.

3. The driving controller of claim 1, wherein the control signal generation part outputs the compensation data signal corresponding to 0 when the count signal is less than a value of the first operation time and a value of the second operation time.

4. A display device comprising:

a display panel comprising a plurality of pixels connected to a plurality of data lines and a plurality of scan lines, respectively;

a data driving circuit which drives the plurality of data lines;

a scan driving circuit which drives the plurality of scan lines; and a driving controller which receives a control signal and an image signal and controls the data driving circuit and the scan driving circuit to display an image on the display panel, wherein the driving controller comprises:

a timer which counts an operation time and outputs a count signal;

a memory which stores first compensation data corresponding to a first operation time and second compensation data corresponding to a second operation time, which is different from the first operation time, wherein the first compensation data and the second compensation data correspond to a predicted result in a production process, and each of the first compensation data and the second compensation data is individually set for each of a plurality of display blocks of the display panel;

a control signal generation part which receives one of the first compensation data and the second compensation data as compensation data from the memory in response to the count signal and outputs compensation data signals based on the compensation data, wherein the compensation data signals correspond to the plurality of display blocks, respectively; and an image processor which converts an image signal into a data signal and outputs the data signal to the data driving circuit, wherein the data signal is obtained by combining the image signal and a compensation data signal corresponding to each of the plurality of display blocks, and wherein each of the plurality of display blocks comprises a plurality of pixels.

5. The display device of claim 4, wherein the second operation time has a value greater than a value of the first operation time, the control signal generation part receives the first compensation data from the memory as the compensation data when the count signal is greater than the value of the first operation time and less than the value of the second operation time, and the control signal generation part receives the second compensation data from the memory as the compensation data when the count signal is greater than the value of the second operation time.

6. The display device of claim 4, wherein the control signal generation part outputs the compensation data signal corresponding to 0 when the count signal is less than a value of the first operation time and a value of the second operation time.

7. The display device of claim 4, further comprising:

a voltage generator which generates a plurality of reference voltages, wherein the data driving circuit converts the data signal received from the image processor into gradation voltages based on the plurality of reference voltages and outputs the gradation voltages to the plurality of data lines.

8. The display device of claim 7, wherein the control signal generation part provides a voltage control signal corresponding to the compensation data from the memory to the voltage generator in response to the count signal, and the voltage generator generates the plurality of reference voltages in response to the voltage control signal.

9. The display device of claim 8, wherein the compensation data stored in the memory further comprises voltage compensation data for setting a voltage level of the plurality of reference voltages, and the voltage compensation data comprises first voltage compensation data corresponding to the first operation time and second voltage compensation data corresponding to the second operation time.

10. The display device of claim 4, further comprising:

a backlight unit which provides light to the display panel.

11. The display device of claim 10, wherein the control signal generation part provides a backlight control signal corresponding to the compensation data from the memory to the backlight unit in response to the count signal, and the backlight unit adjusts a brightness of the light in response to the backlight control signal.

12. The display device of claim 11, wherein the backlight unit is divided into a plurality of light emitting blocks, each corresponding to a display block of the plurality of display blocks.

13. The display device of claim 12, wherein the backlight unit adjusts a brightness of light of each of the plurality of light emitting blocks in response to the backlight control signal.

14. The display device of claim 13, wherein the compensation data stored in the memory further comprises brightness compensation data for setting a brightness of each of the plurality of light emitting blocks, and the brightness compensation data comprises first brightness compensation data corresponding to the first operation time and second brightness compensation data corresponding to the second operation time.

15. The display device of claim 4, wherein the control signal comprises a clock signal, and the timer counts the clock signal to output the count signal.

16. An operating method of a display device, the operating method comprising:

receiving an image signal and a control signal;

counting a clock signal contained in the control signal and outputting a count signal;

receiving first compensation data from a memory of the display device when the count signal reaches a first operation time, wherein the first compensation data is individually set for each of a plurality of display blocks of a display panel;

outputting a data signal obtained by combining the image signal and the first compensation data corresponding to the plurality of display blocks, respectively, wherein the first compensation data and the second compensation data correspond to a predicted result in a production process;

receiving second compensation data from the memory when the count signal reaches a second operation time, which is different from the first operation time, wherein the second compensation data is individually set for each of the plurality of display blocks; and outputting a data signal obtained based on the second compensation data by combining the image signal and the second compensation data corresponding to the plurality of display blocks, respectively, wherein each of the plurality of display blocks comprises a plurality of pixels.

17. The operating method of claim 16, further comprising:

changing a reference voltage of the display device based on the first compensation data when the count signal reaches the first operation time.

18. The operating method of claim 16, further comprising:

adjusting a brightness of light from a backlight unit of the display device based on the first compensation data when the count signal reaches the first operation time.

* * * * *